US007351168B1

(12) United States Patent
Pannell

(10) Patent No.: US 7,351,168 B1
(45) Date of Patent: Apr. 1, 2008

(54) MULTIPLE SPORTS DEVICE

(76) Inventor: Brian E. Pannell, 11809 High Dr., Leawood, KS (US) 66211

( * ) Notice: Subject to any disclaimer, the term of this patent is extended or adjusted under 35 U.S.C. 154(b) by 0 days.

(21) Appl. No.: 11/599,102

(22) Filed: Nov. 14, 2006

(51) Int. Cl.
*A63B 63/00* (2006.01)
*A63B 63/08* (2006.01)

(52) U.S. Cl. ..... 473/476; 473/477; 473/478; 473/479; 273/400; 273/402

(58) Field of Classification Search ..... 273/398–402, 273/407; 473/476–483
See application file for complete search history.

(56) References Cited

U.S. PATENT DOCUMENTS 3,399,889 A * 9/1968 Harry ..... 473/481
3,802,703 A * 4/1974 Van Tassel ..... 273/402
4,169,598 A * 10/1979 Taylor ..... 473/416
4,762,319 A * 8/1988 Krumholz ..... 473/416
4,786,053 A * 11/1988 Barnes, Jr. ..... 473/416
5,249,796 A * 10/1993 Silvi ..... 473/416
5,513,843 A * 5/1996 Russell ..... 473/416
5,564,711 A * 10/1996 Scheie ..... 273/400
5,613,676 A * 3/1997 Connolly ..... 473/416
6,024,659 A * 2/2000 Reed ..... 473/477
6,083,124 A * 7/2000 Williams ..... 473/421
6,899,645 B1 * 5/2005 Hsiao ..... 473/446
7,090,596 B2 * 8/2006 David ..... 473/439
7,247,105 B2 * 7/2007 Huntsberger ..... 473/433
2004/0134108 A1 * 7/2004 Harari ..... 40/600
2005/0062231 A1 * 3/2005 Oister et al. ..... 273/407
2006/0091609 A1 * 5/2006 Dovrat et al. ..... 273/398

* cited by examiner

*Primary Examiner*—Mark S Graham
(74) *Attorney, Agent, or Firm*—Lawrence J. Gibney, Jr.

(57) ABSTRACT

This device is an all-in-one sports combination, which will allow an individual to play soccer, hockey, rollerblade driveway hockey, lacrosse, football, baseball, and basketball, as well as practice kicking a football. The frame structure will allow different height adjustments for a portion of the device so that the height of the device may be adjusted as deemed appropriate by the user.

11 Claims, 8 Drawing Sheets

MULTIPLE SPORTS DEVICE

BACKGROUND OF THE INVENTION

A. Field of the Invention

This relates to sporting equipment and specifically a combination device wherein an individual can play many sports using one piece of equipment.

B. Prior Art

There are many other prior art references related to sporting equipment in general. The current application is different than the other applications that are found in the prior art.

Some representative examples of combination sporting equipment devices include Yoon, U.S. Pat. No. 6,579,196, which is a modular all sports net assembly. This primarily relates to the net as opposed to a multitude of sporting devices. Another example in the prior art can be found at Nichols, U.S. Pat. No. 5,571,266, which is a universal sports net system. Another example in the prior art includes Forlini, U.S. Pat. No. 6,849,009, which is a practice backstop for a net system.

Again, the current application has certain similarities to the prior art. However, none of the other prior art incorporate as many features as the current application.

BRIEF SUMMARY OF THE INVENTION

This is an all sports combination device that will combine a device wherein the individual can play soccer, football, basketball, baseball and also practice kicking a football.

It will consist of a frame. The frame will be open on the bottom and have mesh netting along the sides and top. The top section of the frame is likely to be slightly inclined to form the net structure. On the open end will be a set of goalposts. The goalposts will have extension members that move in a vertical direction and will telescope within the goalpost. A flag will be placed on the top of each extension member. A plurality of holes will be provided on the sides of the extension members so that the extensions can be moved and placed in a particular spot or position relative to the ground.

The basic frame and net structure will allow individuals to play soccer, hockey or lacrosse. In addition to the basic net structure a basketball hoop and backboard with a securement means will be attached to two horizontal members, one on the top of the net structure and the other between the extension members.

Additionally a hoop to practice passing a football through a hoop will be provided. This hoop will be connected to the lower horizontal member using a means to secure.

Additionally, there will be a beanbag, which will imitate a strike zone for a baseball that again can be extended from the upper horizontal member.

If the individual wanted to practice kicking a football, netting for that purpose would be provided. The netting will be secured to the extension members.

Many different types of means to secure the different attachments may be used. These may include hooks, slightly curved pieces of material, hook and loop assembly members, or snaps and buttons to name a few.

The entire device is collapsible and can be stowed in a carrying bag for ease of use and transport.

It is an object of this device to configure and be able to play as many sports as possible with one device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

NUMBER REFERENCES

Figure 1:
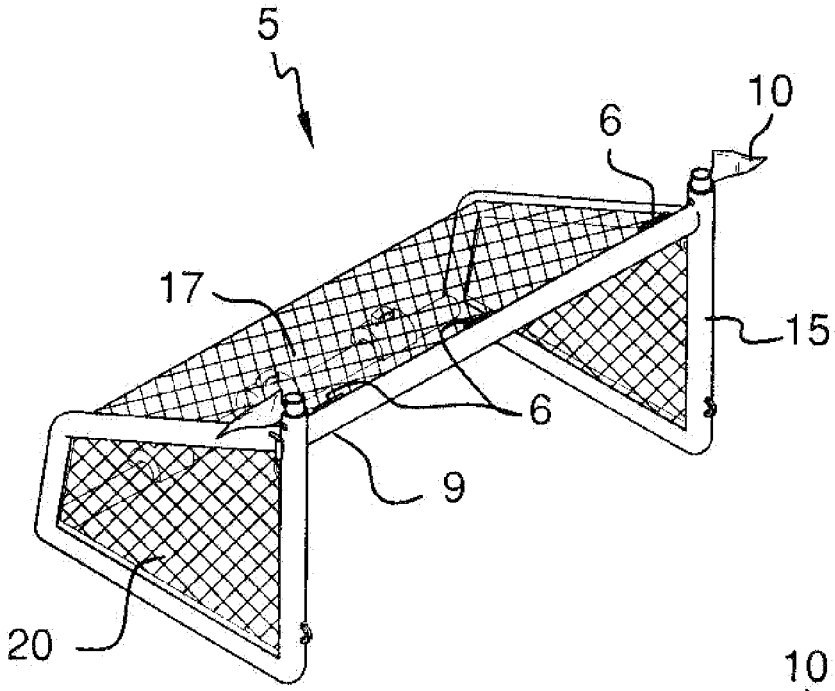
FIG. 1 is an isometric view of the device with the extensions in the down position.
Figure 2:
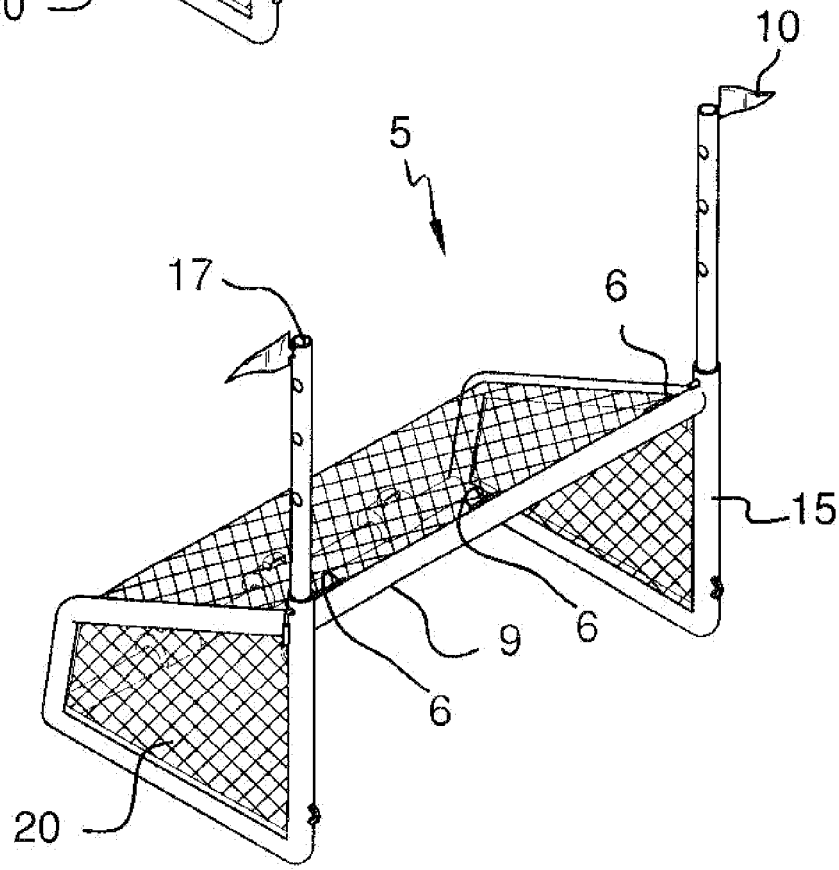
FIG. 2 is an isometric view of the device with the extensions in the up position.

5 Device
6 Velcro tabs
6A Velcro across accessory
6C Loop for pitch back apparatus
7 Weights
8 Bottom frame member
9 Crossbar
10 Flag
13 Pin holder
14 Pin
15 Goalposts
16 Football hoop
17 Extension members
18 Holes
18L Lower horizontal member
18M Middle horizontal member
18U Upper horizontal member
19 Beanbag strike zone
20 Netting
21 Basketball hoop
22 Basketball board
30 Straps
31 Fluorescent color
32 Football Netting
40 Means of connection
41 Hooks
50 Basketball upper horizontal support members
51 Basketball lower horizontal support members
52 Vertical extension
53 Stopper
54 PVC elbow
55 PVC "T"
56 PVC connector
57 Bolts with washers and nuts

60 Vertical extension
61 Stopper
62 Removable horizontal member
65 Pitch back apparatus
66 Net bag holding all parts

DETAILED DESCRIPTION OF THE EMBODIMENTS

This is a multiple sports combination device 5. It will allow an individual to play soccer, lacrosse, hockey, football, baseball, basketball, rollerblade driveway hockey, and to practice kicking. It will be comprised of a frame structure. The frame is likely to have an open bottom and three covered sides with netting 20 and an opening in the front. The netting will be slightly inclined upwards from back to front. It will also have a covered netting top in order to enable an individual to play soccer.

The front of the device will be open and two goalposts 15 will be positioned on the respective ends to form the opening. Between the goalposts another upper horizontal member 18U may be added through openings in the extension members. The lower horizontal member 18L will form the top of the frame structure if any additional horizontal members 18M and 18U have been added. When the device is used to play basketball another horizontal member 18M may be used to support the backboard.

The lower horizontal member 18L does not change as far as height adjustment. The upper horizontal member 18U can move up and down with the movement of the extension members 17 that telescope within the goalpost 15. Flags 10 are placed on one of the extension members for effect.

A plurality of holes in the extension members 17 will allow the additional horizontal members, 18M and 18U, to be secured to the device. Additionally another set of holes 18 are provided in the extension member to allow the extension member to move up and down and to be secured with a pin 14.

Weights, which are installed on the back frame member will be used to maintain the position of the device while playing a particular game. The weight 7 is likely to surround the bottom frame member 8.

The height of the extension member 17 will be adjusted by sliding the pin 14 through the holes in the goalposts 15. For ease of convenience, there is a pin holder 13 on the side of the goalpost 15. The extension members 17 may also be of a fluorescent color 31 for added entertainment effect. The structure is comprised of polyvinylchloride (PVC) piping and could be disassembled with ease and possibly stored in large bag comprised of netting.

First Embodiment

In the first embodiment with the basic frame structure, the individual can play soccer, hockey and lacrosse or driveway rollerblade hockey such as depicted in FIG. 1.

Second Embodiment

Figure 3:
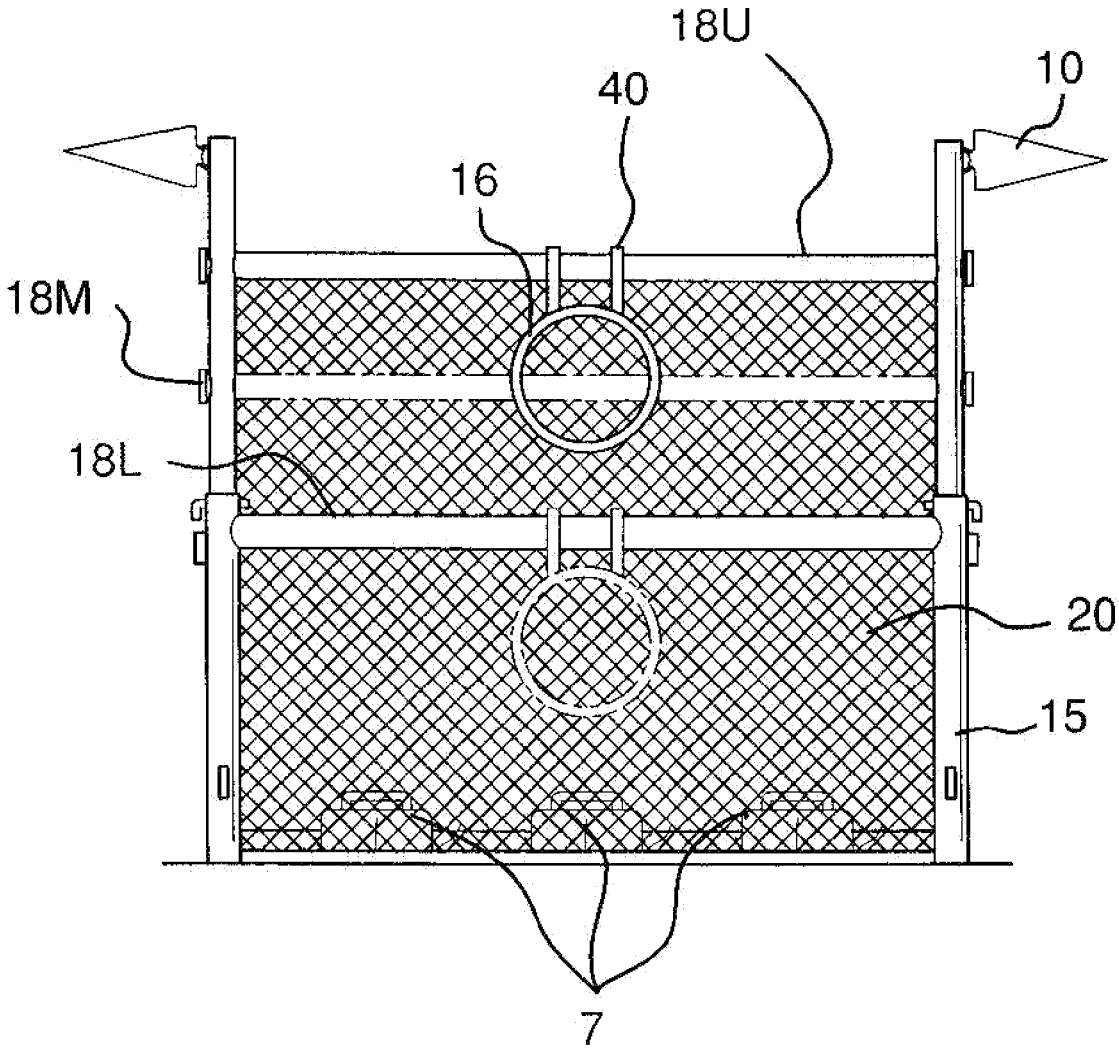
FIG. 3 is a front view of the device with the football hoop secured to the horizontal member.
Figure 4:
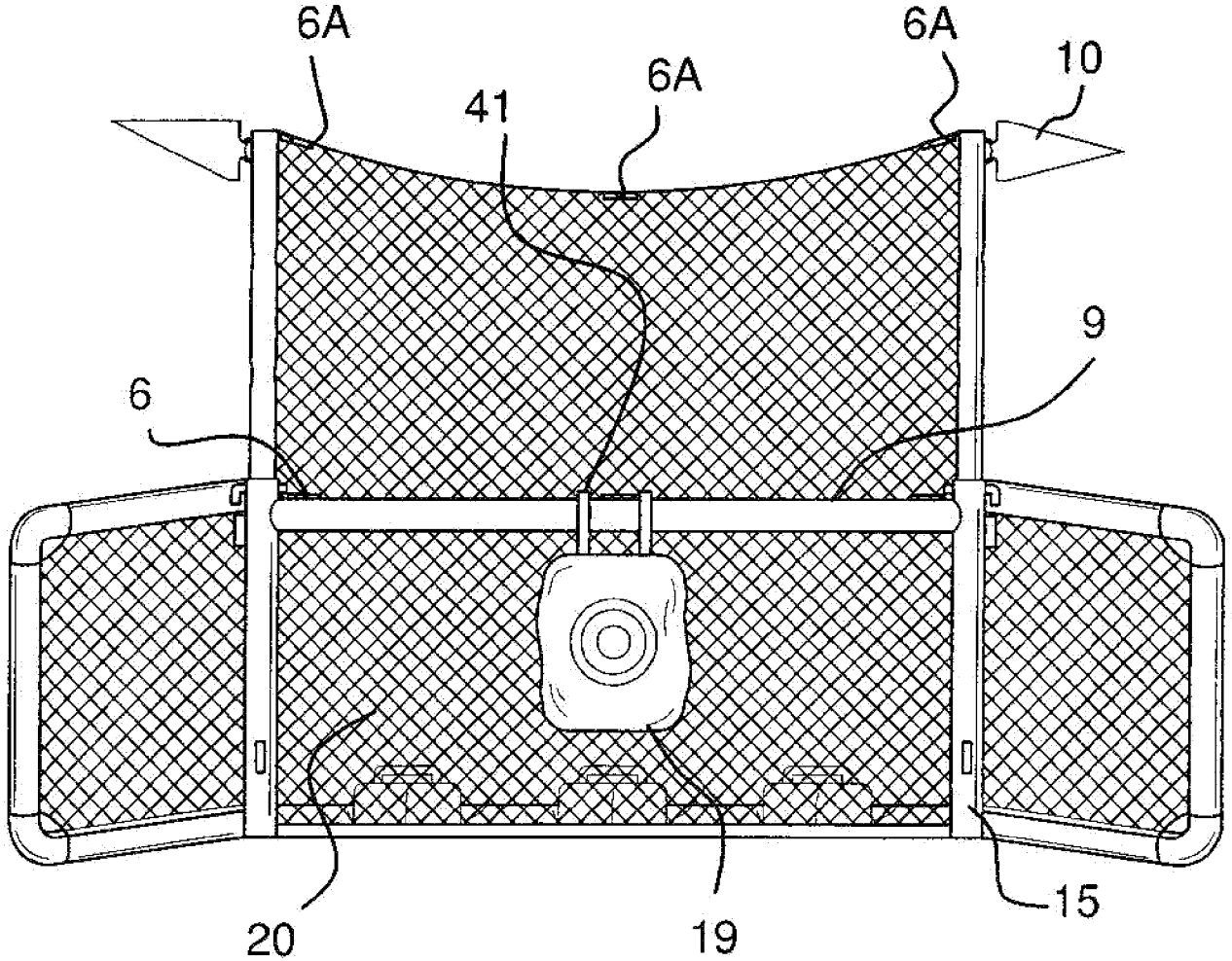
FIG. 4 is a front view of the device with the strike zone indicator secured to the horizontal member.
Figure 6:
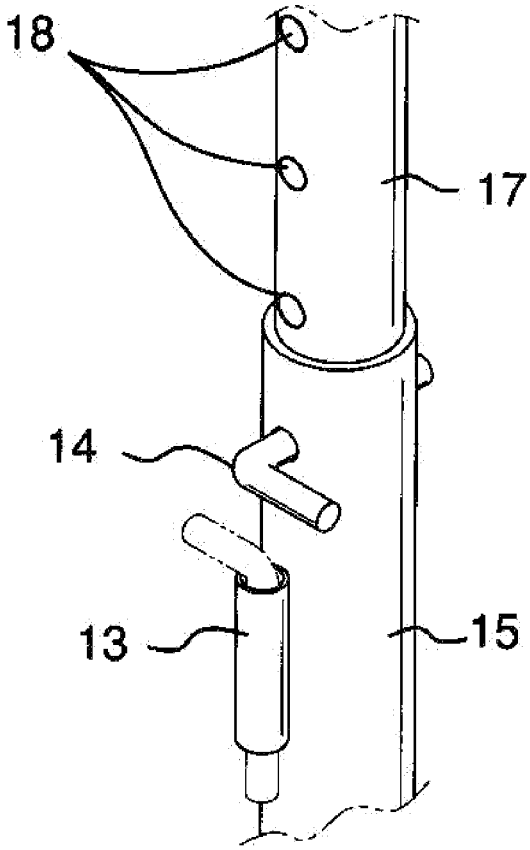
FIG. 6 is a partially fragmented view indicating the height adjustment mechanism.

The device can also be used to have an individual practice passing a football through a hoop such as depicted in FIG. 3. The football hoop 16 is round and may be secured to the lower horizontal member 18L or upper horizontal member 18U with a means of connection 40. The hoop 16 is provided with a multitude of ways to secure it to the desired horizontal member, a multitude of ways to secure the straps, and hooks 40 may be used.

Third Embodiment

In addition to soccer and football, an individual may also practice throwing a baseball at a beanbag strike zone 19. The beanbag strike zone will hang from the lower horizontal member, using a connection means for that purpose. The means of connection will be similar to the means of connection for the football hoop and is likely to be a plurality of hooks 41 for that purpose. The sides of the frame may rotate outwards to form a larger area in this embodiment.

Fourth Embodiment

Figure 5:
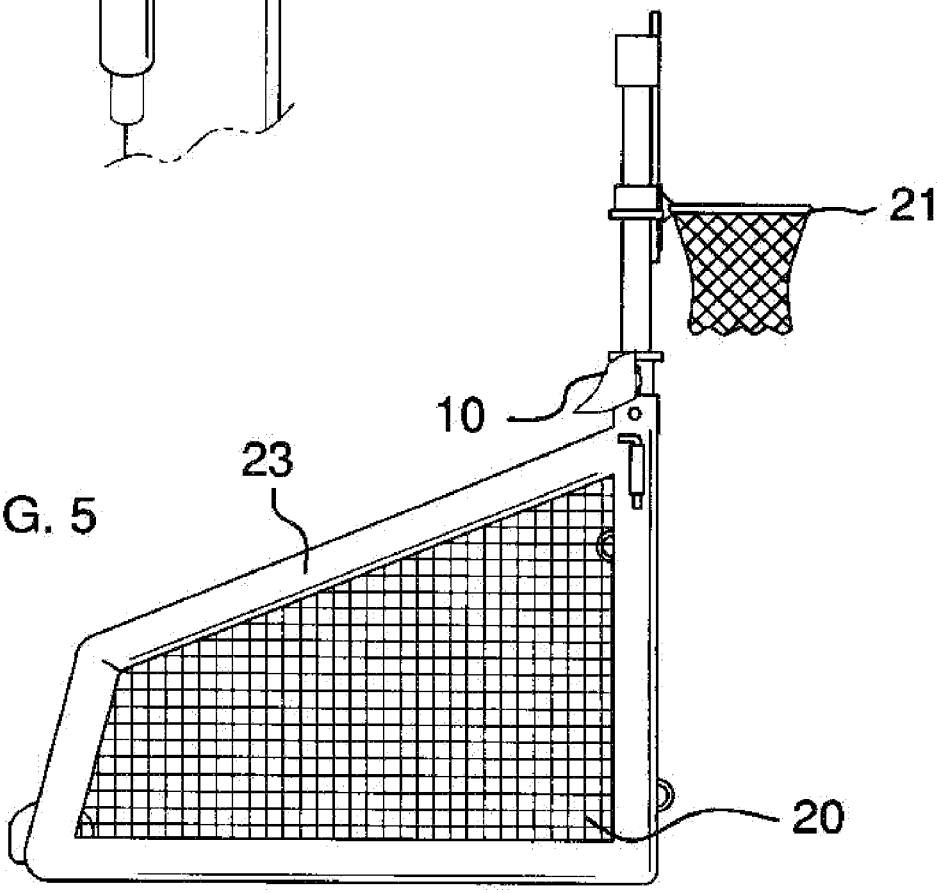
FIG. 5 is a side view of the device with the basketball hoop secured to the horizontal member.
Figure 5A:
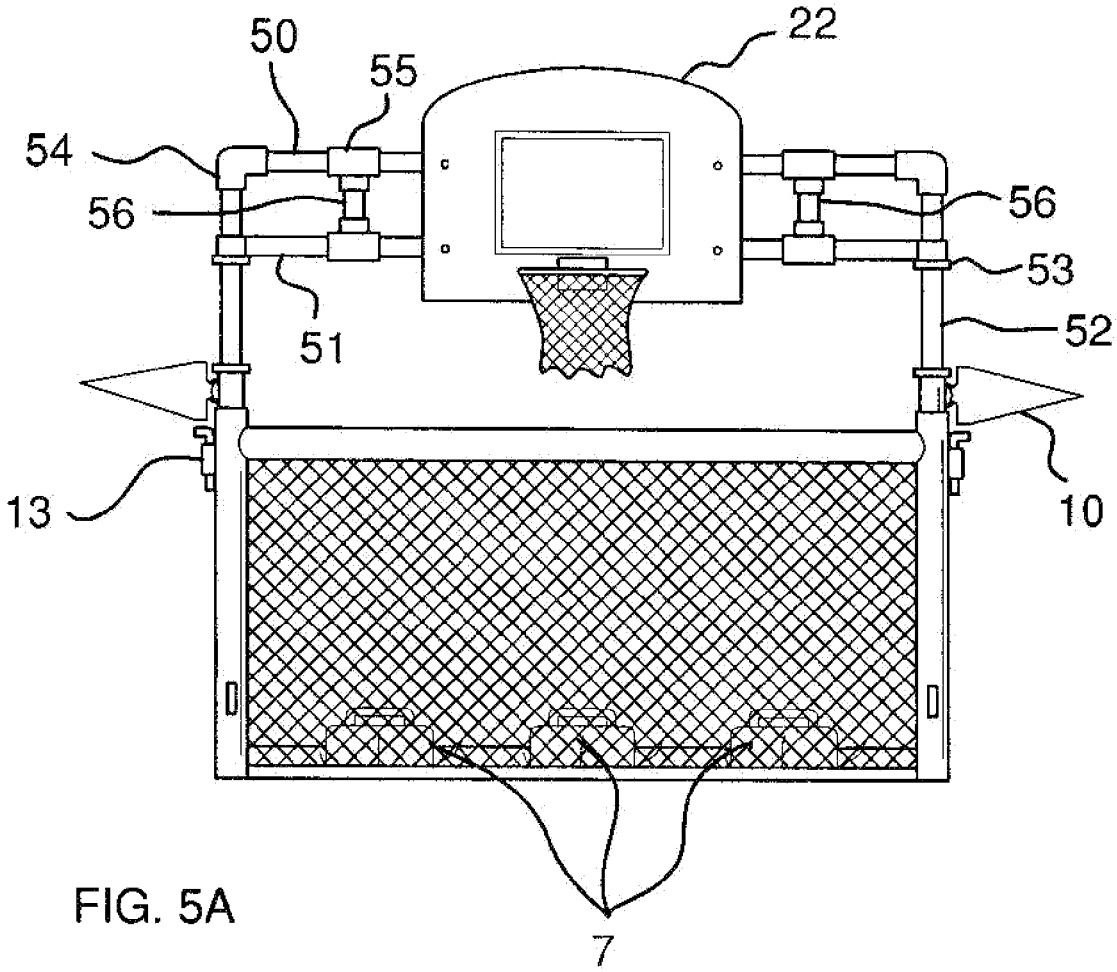
FIG. 5A is a front view of the device used to play basketball.
Figure 5B:
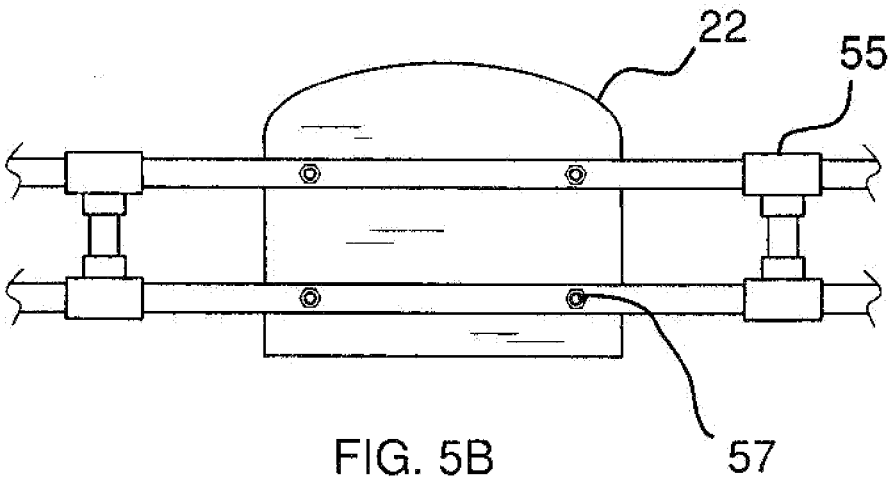
FIG. 5B is a fragmented back view of the basketball backboard.

Additionally, the device may also be used to practice basketball. The basketball rim will be secured to a backboard 22, which is secured to both the upper and a cross bar 51 for that purpose horizontal members, using a means to secure such as a plurality of bolts 57. FIG. 5B In the front will be a basketball hoop 21. The height of the basketball hoop may be adjusted by moving the upper horizontal members up and down within the goalposts. The backboard 22 is mounted on a structure which is comprised of a series of pieces of piping including nipples 56 and Ts 55 that purpose.

Fifth Embodiment

Figure 7:
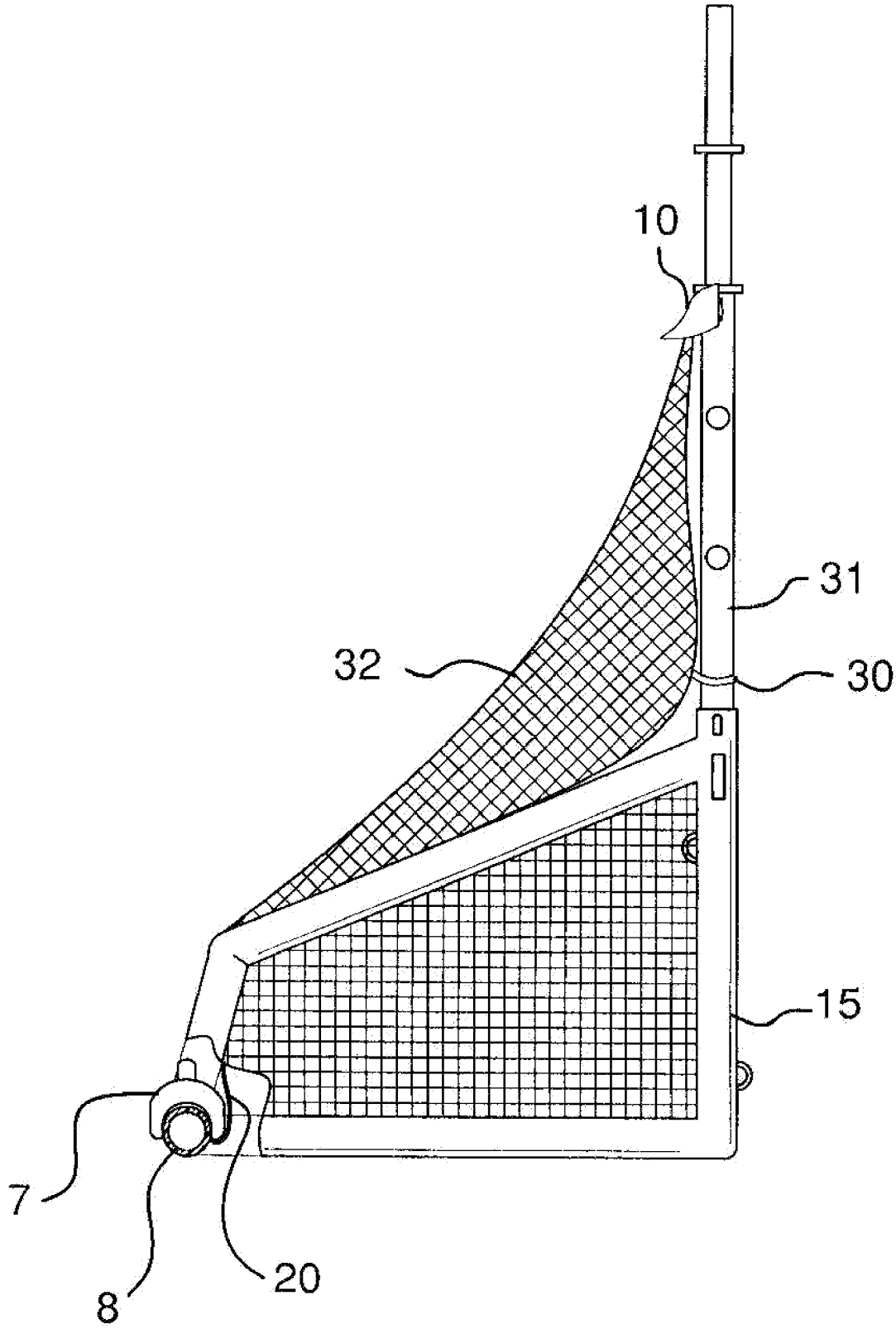
FIG. 7 is a side view of the device depicting the device being used when practicing to kick a football.
Figure 8:
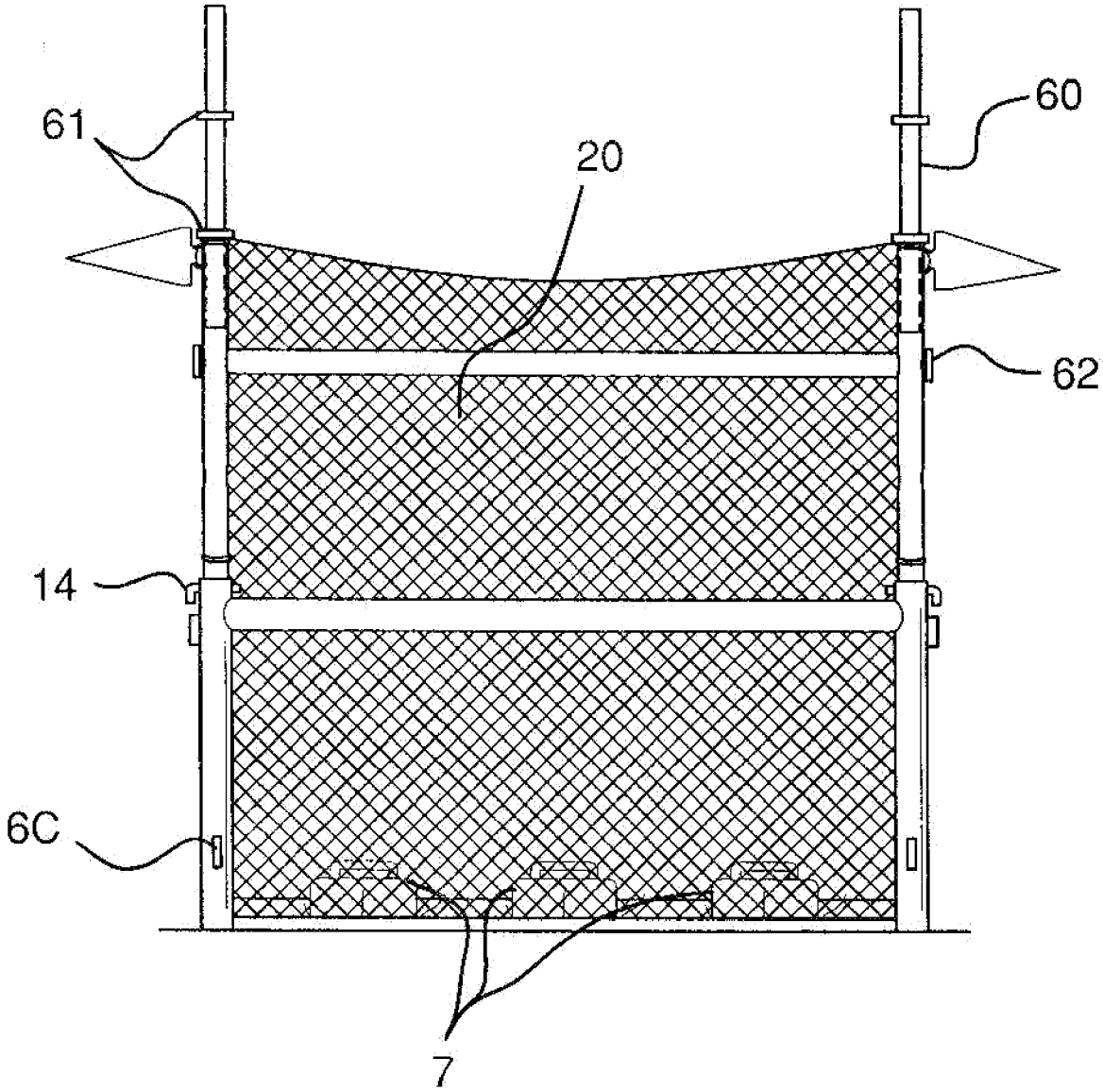
FIG. 8 is a front view of the device with the extension members in the raised position.
Figure 9:
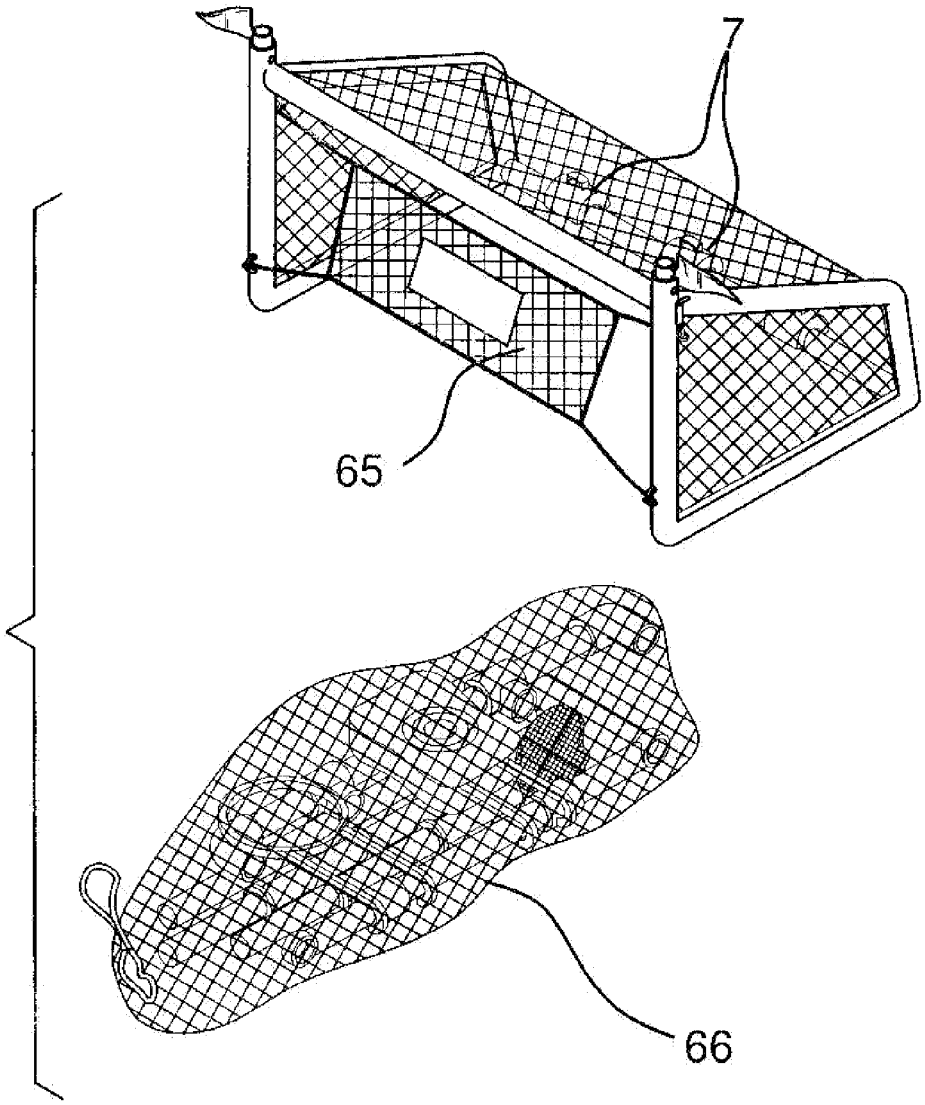
FIG. 9 is an isometric view of the device when it is used to practice throwing a ball and a picture of the device stowed in a carrying bag.

An individual may also use this device to practice kicking a football through the goalposts, using a net 32 for that purpose. The net will be secured to the extension pieces, using straps 30. FIG. 7

Sixth Embodiment

Pitch back elastic netting 65 attached to the front of the goal structure by means of bungee straps at the four corners may also be incorporated into this device.

The inventor claims:

1. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
wherein a flag is secured to the top of the extension members;
d. extension members;
wherein extension members telescope within the goalposts;
wherein a flag is secured to the top of the extension members;
wherein a plurality of holes on the sides of the extension members are provided;
wherein a plurality of openings in the extension members are provided;
said openings allow for horizontal members to be used;
said holes allow for height adjustment of the extension members;
e. horizontal members;
wherein an upper horizontal member may be placed between the extension members;
wherein the openings are provided to secure the horizontal members;
said upper horizontal member is secured to the extension members;
wherein a plurality of horizontal members may be used;
wherein a lower horizontal member is placed on the top of the frame;
said lower horizontal member is secured to the goalposts.

2. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
d. extension members;
wherein extension members telescope within the goalposts;
wherein a flag is secured to the top of the extension members;
wherein a plurality of holes on the sides of the extension member are provided;
wherein a plurality of openings in the extension members are provided;
said openings allow for other horizontal members to be used;
said holes allow for height adjustment of the extension members;
e. horizontal members;
wherein an upper horizontal member may be placed between the extension members;
wherein openings are provided to secure the horizontal members;
said upper horizontal members are secured to the extension members;
wherein a plurality of horizontal members may be used;
wherein a lower horizontal member is placed on the top of the frame;
said lower horizontal member is secured to the goalposts;
f. a football hoop;
wherein said football hoop may be secured to a horizontal member;
wherein a means to connect is provided.

3. The device as described in claim 2 wherein the means to connect is a plurality of hooks.

4. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
d. extension members;
wherein extension members telescope within the goalposts;
wherein a flag is secured to the top of the extension members;
wherein a plurality of holes on the sides of the extension member are provided;
wherein a plurality of openings in the extension members are provided;
said openings allow for other horizontal members to be used;
said holes allow for height adjustment of the extension members;
e. horizontal members;
wherein an upper horizontal member may be placed between the extension members;
wherein openings are provided to secure the horizontal members;
said upper horizontal members are secured to the extension members;
wherein a plurality of horizontal members may be used;
wherein a lower horizontal member is placed on the top of the frame;
said lower horizontal member is secured to the goalposts;
f. a baseball strike zone;
wherein said baseball strike zone may be secured to a horizontal member;
wherein a means to connect is provided.

5. The device as described in claim 4 wherein the means to connect is a plurality of hooks.

6. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
d. extension members;
wherein extension members telescope within the goalposts;
wherein a flag is secured to the top of the extension members;
wherein a plurality of holes on the sides of the extension member are provided;
wherein a plurality of openings in the extension members are provided;
said openings allow for other horizontal members to be used;
said holes allow for height adjustment of the extension members;
e. horizontal members;
wherein an upper horizontal member may be placed between the extension members;
wherein openings are provided to secure the horizontal members;
said upper horizontal members are secured to the extension members;
wherein a plurality of horizontal members may be used;
wherein a lower horizontal member is placed on the top of the frame;
said lower horizontal member is secured to the goalposts;
f. a basketball rim;
wherein said basketball rim may be secured to a plurality of horizontal members;
wherein a means to connect is provided.

7. The device as described in claim 6 wherein the means to connect is a plurality of bolt and nuts.

8. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
d. extension members;
wherein extension members telescope within the goalposts;
wherein a flag is secured to the top of the extension members;
wherein a plurality of holes on the sides of the extension member are provided;
wherein a plurality of openings in the extension members are provided;
said openings allow for other horizontal members to be used;
said holes allow for height adjustment of the extension members;
e. horizontal members;
wherein an upper horizontal member may be placed between the extension members;
wherein openings are provided to secure the horizontal members;
said upper horizontal members are secured to the extension members;
wherein a plurality of horizontal members may be used;
wherein a lower horizontal member is placed on the top of the frame;
said lower horizontal member is secured to the goalposts;
f. a pitch back netting;
wherein said pitch back netting in secured to the goalposts in the area of the opening;
wherein a means to secure is provided.

9. The device as described in claim 8 wherein the means to secure is a plurality of straps.

10. A sports combination device,
which is comprised of:
a. a frame;
wherein the frame has sides;
wherein the frame has a top;
wherein the frame has a bottom;
wherein the frame has a back;
wherein the frame has a front;
wherein the frame is open at the front;
b. netting;
wherein netting is placed on the sides and top of the frame;
c. goalposts;
wherein a pair of goalposts secure the front to provide a structure for the frame and provide the opening in the front;
d. extension members;
wherein extension members telescope within the goalposts;
wherein a flag is secured to the top of the extension members;
wherein a plurality of holes on the sides of the extension member are provided;
wherein a plurality of openings in the extension members are provided;
said openings allow for other horizontal members to be used;
said holes allow for height adjustment of the extension members;
e. horizontal members;
wherein an upper horizontal member may be placed between the extension members;
wherein openings are provided to secure the horizontal members;
said upper horizontal members are secured to the extension members;
wherein a plurality of horizontal members may be used;
wherein a lower horizontal member is placed on the top of the frame;
said lower horizontal member is secured to the goalposts;
f. a football netting;
wherein said football netting in secured to the extension members after the extension members are raised; in the area of the opening;
wherein a means to secure is provided.

11. The device as described in claim 10 wherein the means to secure is a plurality of straps.

* * * * *